US005644802A

United States Patent [19]

Olin

[11] Patent Number: 5,644,802

[45] Date of Patent: Jul. 8, 1997

[54] VACUUM SEWER ARRANGEMENT

[75] Inventor: Henry Olin, Espoo, Finland

[73] Assignee: Evac AB, Bromolla, Sweden

[21] Appl. No.: 700,125

[22] Filed: Aug. 20, 1996

Related U.S. Application Data

[63] Continuation of Ser. No. 309,581, Sep. 20, 1994, abandoned.

[30] Foreign Application Priority Data

Sep. 21, 1993 [FI] Finland ..... 934126

[51] Int. Cl.[6] ..... E03D 11/00

[52] U.S. Cl. ..... 4/431; 96/195; 96/208; 96/216

[58] Field of Search ..... 4/300, 431–433, 4/321–323; 96/195, 208, 216

[56] References Cited

U.S. PATENT DOCUMENTS 4,034,421 7/1977 Pihl et al. .
4,332,041 6/1982 Kristoffersen .
4,521,925 6/1985 Chen et al. .
4,819,279 4/1989 Sigler et al. ..... 4/300
4,865,631 9/1989 Stroby et al. .
4,963,094 10/1990 Meyer ..... 433/95
5,002,592 3/1991 Stroby et al. .
5,214,807 6/1993 Terve .

*Primary Examiner*—Charles E. Phillips
*Attorney, Agent, or Firm*—Smith-Hill and Bedell

[57] ABSTRACT

A simplified vacuum sewer arrangement comprises a limited number of toilet bowls, preferably at the most 60 toilet bowls, which through a sewer pipe are connected to a common sewage collecting container, and a dry rotary vane pump for generating and maintaining a considerable partial vacuum in the sewer pipe and in the collecting container. The sewage collecting container is a relatively small reservoir which has to be frequently emptied and the volume of which is preferably at the most 100 liters. A liquid separator protects the pump from moisture. A rigidly installed tube and valve system connects the pressure side of the dry rotary vane pump periodically to the collecting container for emptying the container to another location by means of the pressure created by the dry rotary vane pump.

19 Claims, 3 Drawing Sheets

23
27
1a
2
1
26
5b
5
5a
22
21
21a
7
27a
6a
24
25
35
8a
3
6
34
27b
33
8
29
8b
10
12
11
18
9
9a
4
16
19
8c
A
17
14
15
13

III
23
30
35
5
(8a,b,c)
(27)
(1)
27a
27
3
8
10
6a
18
29
19
30
9
30
11
9a
27
17
11
9
25
27b
8
4
4
15
14

VACUUM SEWER ARRANGEMENT

BACKGROUND OF THE INVENTION

This is a continuation of application Ser. No. 08/309,581 filed Sep. 20, 1994 and now abandoned.

The invention relates to a simplified vacuum sewer arrangement for toilets and a method of operating such an arrangement.

Nowadays ships almost invariably use vacuum sewer toilets. The bowls of such toilets are connected, through a normally-closed sewer valve, to a sewer pipe that is kept under considerable partial vacuum. Modern marine vacuum sewer arrangements are almost without exception devised according to U.S. Pat. No. 4,034,421. This kind of arrangement is well suited for systems including a large number of toilets, but is unnecessarily expensive in ships where the number of toilets is relatively small. For instance, freighters or cargo ships usually have only between 5 and 40 toilets. An inexpensive, easy to install, and reliable toilet vacuum sewer arrangement for this kind of ship has not been commercially available heretofore.

It is known to use a liquid ring pump for generating a partial vacuum in a sewer system, where moisture and dirt abound. A liquid ring pump is reliable and operates well, but its efficiency rate is low, which means that its power demand is high. Additionally, a liquid ring pump needs an expensive automatic arrangement to ensure that there is always enough water in the liquid ring of the pump. The vacuum sewer arrangement according to U.S. Pat. No. 4,034,421, does not use a liquid ring pump. Instead, a circulation pump runs an ejector pump that produces the required vacuum. This combination operates reliably but its efficiency rate is only about 5 percent.

SUMMARY OF THE INVENTION

This invention seeks to provide a simplified vacuum sewer arrangement with low manufacturing and installation costs that is well suited for use in vacuum sewer arrangements in which the number of toilet bowls is significantly less than 100 units and in which it is unlikely that very many toilet bowls will be flushed at the same time. The invention has particular, but not exclusive, application to ships.

In accordance with the present invention there is provided a vacuum sewer arrangement comprising a plurality of toilet bowls, a common sewage collecting container, sewer piping connecting the toilet bowls to the common sewage collecting container, a dry rotary vane pump having a pressure side and a suction side, a tube and valve system having a first condition in which the suction side of the pump is connected to the collecting container for generating and maintaining a considerable partial vacuum in the sewer piping and in the collecting container, and a second condition in which the pressure side of the pump is connected to the collecting container for expelling the contents of the collecting container, and a protective liquid separating means for preventing liquid in the collecting container from reaching the pump.

The invention is based on the concept that, contrary to the trend of the prior art, a dry rotary vane pump could be used as a vacuum pump. Although this kind of pump is relatively cheap and has good efficiency, dry vane pumps do not tolerate moisture, Thus to make it possible to use a dry rotary vane pump in a vacuum sewer arrangement according to the invention, it is necessary to protect the pump very effectively, by means of a liquid separating means, so that it does not become exposed to humidity. Providing that operating conditions suitable for a dry rotary vane pump can be arranged, a dry rotary vane pump is a surprising but an extremely advantageous component in a vacuum sewer arrangement according to the invention and its power can be as low as 0.4 kW or even less.

For making it easy to install a vacuum sewer arrangement according to the invention in a ship, even in a restricted space, it is important that the component parts of the arrangement have small dimensions and are so formed and arranged that they may all be easily integrated in a module with small exterior dimensions. Such a module suitably has the form of a fully prefabricated rigid unit that may be installed in a ship and simply connected to the shipboard vacuum sewer network and to its electric network. For making this possible, the sewage collecting container has to be relatively small, and consequently, it has to be emptied quite frequently. The emptying of the collecting container may take place to a larger sewage storage tank, to a sewage treatment plant, or direct into the sea. In harbour, the emptying may take place to any available sewage transport or adjacent treatment system.

Because the collecting container of a vacuum sewer arrangement according to the invention must be emptied relatively frequently, it is desirable that the emptying process be automated or an arrangement providing convenient emptying of the collecting container be provided. Therefore, it is helpful that there be a fixed tube and valve system, by means of which the collecting container is emptied. According to the invention, the dry rotary vane pump of the vacuum sewer arrangement is also used in the emptying phase of the collecting container, the suction side of the pump then being connected to the ambient air and the pressure side of the pump to the collecting container, whereby the pump pressure empties the container. Because the dry rotary vane pump is used both for producing vacuum and for emptying the collecting container, the number of elements in the vacuum sewer arrangement may be minimized and the production costs of the arrangement, and particularly a prefabricated module therefor, can be kept low.

Because it is important that moisture is not sucked into a dry rotary vane pump, one must pay close attention as to how the sewage is to be drawn into the collecting container. Splashing should be avoided, because it may cause liquid to be sucked into the vacuum pump. Therefore, in a preferred embodiment of the invention, the sewer pipes of the toilet bowls are connected to the collecting container through a common end tube that is connected to the collecting container so that the liquid sewer flow into the collecting container takes place as peacefully as possible. This is accomplished, in a preferred embodiment, by connecting the end tube of the sewer pipe to the collecting container via an air separation device, in which the sewage is separated from the air accompanying it. In this way the flow speed of the sewage is reduced before the sewage arrives in the interior of the collecting container. The collecting container may be cylindrical and the end tube of the sewer pipe may be mounted to lie against the circumferential surface of the collecting container. The side of the end tube that is facing the center of curvature of the circumferential surface of the collecting container then has a plurality of apertures that open into the interior of the collecting container, so that the end tube itself works as a the air separation device, in which the air accompanying the sewage is bled from the sewage as the sewage approaches its entry point into the collecting container. Desirably the shape of the air separation device is such that the sewage flows into the collecting container mainly tangentially, which greatly reduces splashing and other disturbances in the mass of mainly liquid sewage contained in the collecting container.

From a structural point of view, it is easy to mount the air separation device around the circumference of the collecting container against its outer surface, but it is also feasible to place the air separation device against the inner surface of the collecting container or join it, for example, to a cover structure of the container, in such a manner that it assumes a proper position, when the cover is mounted in place. This last-mentioned solution has the advantage that the structure of the remainder of the collecting container may then be extremely simple.

If the collecting container is cylindrical and has a flat bottom, and is mounted with its longitudinal axis slightly offset from a vertical position, the lowest section of the container's oblique bottom forms a space, in which the inlet end of a tube for emptying the container can advantageously be installed. The container can then be emptied much more completely than if the container has a horizontal flat bottom. Setting the collecting container slightly offset from the vertical does not cause difficulties in mounting the end tube of the sewer, because the end tube may, in spite of the offset position of the collecting container, easily be mounted on the circumferential surface of the collecting container or in its close proximity, so that each section of the end tube still slopes downwardly.

It is also feasible that the collecting container be a cylindrical pressure vessel with convex ends (for example according to DIN 28022). At the lowest point of the bottom of the container, a downwards directed emptying tube may be connected.

The collecting container must always have a large enough space under vacuum, when flushing of any of the toilet bowls takes place. To ensure this, it is recommended to have an automatic emptying system providing, under the control of a level monitor or the like, emptying of the collecting container, when it has become about half full of sewage. If the level monitor is situated inside the collecting container, the air flow caused in the collecting container by the dry rotary vane pump when suction and/or pressure is produced, can be directed along or against the level monitor, so that the air flow keeps it clean from matter that could otherwise stick to it.

It is desirable that the sewage flows into the collecting container mainly in the form of liquid plugs. Such a plug is discharged into the sewer pipe when any of the vacuum toilet bowls is flushed, but the sewer pipe may be so long that the plug does not reach the collecting container during that flushing operation. To make sure that plug flow into the container does occur, a U-shape trap can be provided in the sewer pipe just upstream of the collecting container, which trap forms a collecting pocket for liquid present in the end portion of the sewer. Sewage collected in the trap forms a liquid plug, and this liquid plug flows into the collecting container pushed by the pressure impulse caused by the next toilet bowl flushing. Thus, the flow of sewage into the collecting container always takes place in the form of liquid plugs, which enhances the functioning of the air separation device of the collecting container.

It is advantageous if the dry rotary vane pump has only one air flow connection to the collecting container through which connection the collecting container is maintained under partial vacuum a well as under pressure. The air flow created during the vacuum generating phase, in a direction from the collecting container to the dry rotary vane pump, can be led to the pump through a moisture separator, which preferably is so devised, that it works also as a means protecting the collecting container against overfilling, or in other words so that if the collecting container is filled completely, the level of sewage in the arrangement cannot go above the level of the overfilling protecting means. By this means a simple and reliable vacuum sewage arrangement is obtained, that functions in an acceptable manner even under fault conditions.

BRIEF DESCRIPTION OF THE DRAWINGS

The invention will be described more fully with reference to the accompanying drawings, in which.

DETAILED DESCRIPTION

Figure 1:
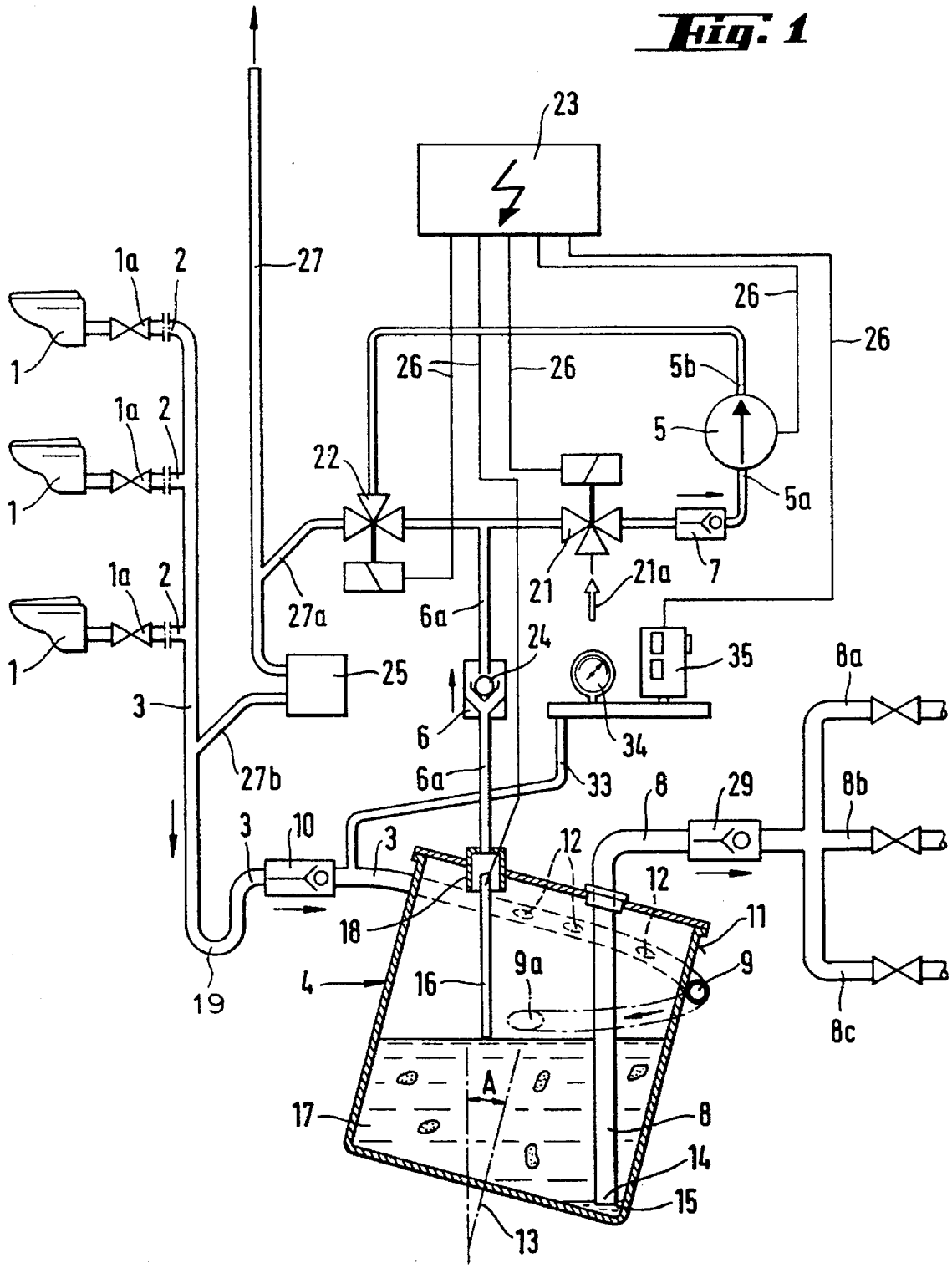
FIG. 1 is a schematic view of a vacuum sewer arrangement according to the invention.

In the drawings, numeral 1 indicates WC toilet bowls installed on board a ship. Each toilet bowl 1 is, through a normally-closed sewer valve la, connected to a sewer pipe 2, that is kept under partial vacuum and at its downstream end, by means of an end tube 3 and a check valve 10, communicates with a collecting container 4.

The number of toilet bowls in an arrangement according to the invention is usually at the most 60. However, from the point of view of functional reliability, it is recommended that the number of toilet bowls is less than this, for example between 30 and 40, and that the arrangement is so devised, that normally not very many toilet bowls will be flushed at the same time. If necessary, the arrangement may be provided with some form of flush-preventing or flush-delaying means. Such restrictions and/or restrictive actions are necessary primarily because the power of the vacuum pump of the arrangement is relatively small and the volume of the collecting container 4 is also relatively small. The total volume of the collecting container 4 may be only about 50 liters, but it could be larger than this. The total volume of the interior of the vacuum sewer pipes 2 and end tube 3 is typically about 400±100 liters.

The partial vacuum and the pressure required in the vacuum sewer arrangement illustrated is provided by a dry rotary vane pump 5, the suction side 5*a* of which is connected to the collecting container 4 via a check valve 7, a liquid separator or moisture separation device 6, a tube or air duct 6*a* and an air guide pipe 18. The pressure side 5*b* of the dry rotary vane pump 5 is then through a remote-controlled three-way valve 22 and tubes 27*a* and 27 connected to the atmosphere. The partial vacuum generated by the pump 5 in the sewer system 2, 3 and in the collecting container 4 is usually about 50 percent of the atmospheric pressure.

For emptying sewage 17 from the collecting container 4, the suction side 5*a* of the pump 5 is, through a remote-controlled three-way valve 21, connected to the atmosphere, the inflow of ambient air being represented by the arrow 21*a*, and the pressure side 5*b* of the pump 5 is connected, through the other remote-controlled three-way valve 22 and through the tube 6*a*, to the collecting container 4. The pressure generated by the pump 5 then acts on the sewage 17, because the pressure cannot escape through the check valve 10. The pressure forces the sewage 17 in the container 4 into the tube 8 and through it and a further check valve 29 to some other location, for example through a tube 8*a* to a treatment plant in a harbour, through a pipe 8*b* to a treatment plant or a larger storage tank on board the ship, or through a pipe 8*c* to the sea.

It will therefore be seen that the tube 6*a* forms a single air duct connecting the collecting container 4 to the suction side 5*a* or the pressure side 5*b* of the pump, depending on the conditions of the valves 21 and 22.

When any of the toilet bowls 1 is flushed, about 1 liter or less of rinse water is led to the toilet bowl and at practically the same time the sewer valve 1*a* of the toilet bowl is opened. The partial vacuum present in the sewer pipe 2 then causes the atmospheric pressure to push the rinse water and other matter present in the toilet bowl into the sewer pipe 2, in which a sewage plug moving at high speed is formed. This plug, or possibly a plug created in the sewer pipe earlier, moves rapidly into a curved tube 9 that extends around the collecting container 4 above the normal maximum filling level of the container. The side of the tube 9 that contacts the container 4, and is therefore toward its center of curvature, is provided with apertures 12 communicating with the interior of the container. The tube 9 operates as an air separation device, since the action of centrifugal force causes the matter that is heavier than air to move to the side of the curved tube 9 that is outwards from its center of curvature, while air present with the plug finds its way to the side of the curved tube 9 facing its center of curvature and is discharged into the collecting container 4 through the apertures 12. Finally, the sewage plug, flowing now rather slowly, passes into the collecting container 4 mainly tangentially through an end opening 9*a* of the tube 9.

The sewer pipes 2 leading from the toilet bowls 1 communicate with the end tube 3, in which there is provided a U-shaped curve 19 forming a liquid-collecting trap. In this trap at least a part of the liquid remaining in the sewer pipes is collected, forming there a liquid plug, which ensures that each sewage discharge which passes into the curved tube 9 includes a liquid plug.

The level of sewage 17 preferably does not rise above half the depth of the collecting container 4 so that sewage can enter the container 4 without excessive splashing, because the apertures 12 and 9*a* of the separating device created by the tube 9 are above the sewage level.

A level monitor 16 is provided in the collecting container 4 to monitor the amount of sewage 17 present therein. The dry rotary vane pump 5 generates air flows in the container when partial vacuum is generated as well as when pressure is generated. By means of the air guide pipe 18 at the collecting container end of the tube 6*a*, these air flows are led along the surface of the level monitor 16, whereby the monitor is cleaned of matter that might possibly stick to it.

The liquid separator 6, shown only schematically, forces the air flow flowing through it to the pump 5 to make several sharp changes in flow direction, whereby the action of centrifugal force separates any liquid drops present from the air. The velocity of the air flow through the liquid separator 6 is also essentially slowed down at points where the cross-sectional area of the flow path is large, which also is likely to cause separation of water drops flowing with the air. The separated liquid flows through the lower part of the tube 6*a* back to the collecting container 4. If the collecting container 4, in a case of disturbance, is filled up totally, in other words to such a high level that the liquid level rises up to the liquid separator 6, a float 24 present therein closes the connection to the upper part of the tube 6*a*. This prevents the liquid level from rising higher than the liquid separator 6 and thereby protects the tube and valve system from overfilling of the collecting container.

The cylindrical collecting container 4 has in the embodiment illustrated a slightly oblique disposition, so that its longitudinal axis 13 forms an angle A to the vertical. This ensures that the inlet end 14 of the outlet tube 8, which extends into the container from its top, is in close proximity to the lowest part 15 of the obliquely mounted collecting container 4. This gives the advantage that following a full emptying operation, the collecting container is effectively completely emptied, except for an extremely small amount of sewage remaining therein at a point 15.

A collecting and separating device 25, for example, condensed liquid, is shown connected to the lower end of the mainly vertical tube 27. Any liquid collected in the device 25 is, in a known manner by means of partial vacuum, led through a pipe 27*b* to the sewer 3 and therethrough to the collecting container 4. In the device 25 one may use technical solutions of the kind shown in U.S. Pat. No. 4,057,076, U.S. Pat. No. 4,280,528, Swedish Patent Publication B-398, 654, or British Patent Publication A-1,312,601.

The operation of the vacuum sewer arrangement and the tube and valve system is monitored and controlled by a control center 23, receiving, through electric cables 26, data relating to the operational conditions of the different units of the arrangement. Some of this data is provided by a pressure controlled relay 35 connected via a tube 33 to the sewer 3 downstream of the check valve 10 or directly to the container 4. Also shown is a pressure gauge 34 connected in parallel with the relay 35.

Figure 2:
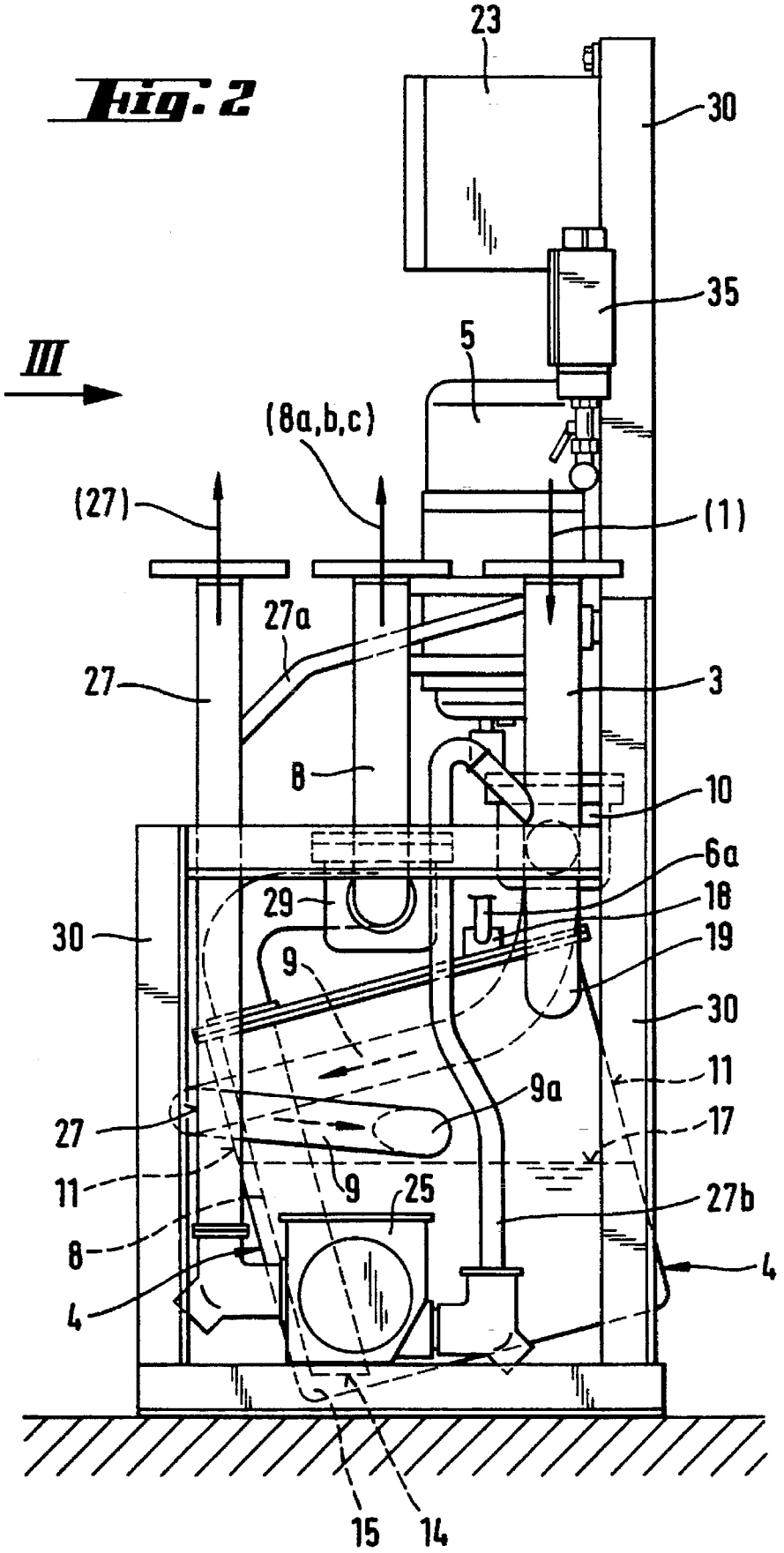
FIGS. 2 and 3 show, in end view and front view, respectively, an implementation of the major part of a system according to the invention constructed as a compact module.
Figure 3:
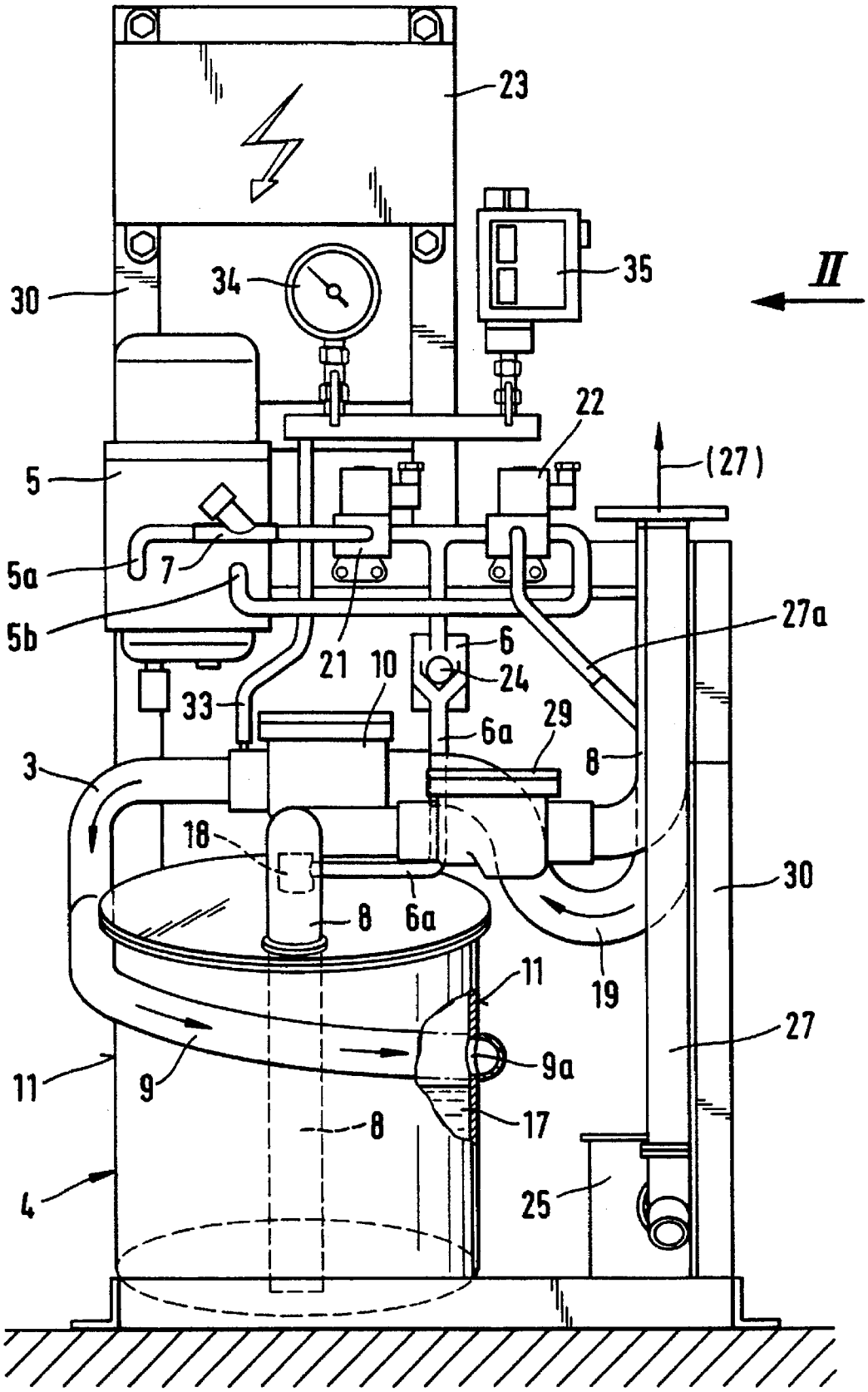

FIGS. 2 and 3 shown how the component parts 3–29 and 33–35 of FIG. 1 may be arranged in a prefabricated module having a frame 30 for mounting the described equipment and for fixing the component parts in place. A mounting module of this kind can be designed to be so compact that it requires a floor area of less than 0.5 $m^2$.

The invention is not limited to the embodiments illustrated since several variations and modifications thereof are feasible within the scope of the following claims.

I claim:

1. A vacuum sewer arrangement comprising:

a plurality of toilet bowls, a common sewage collecting container, sewer piping connecting the toilet bowls to the common sewage collecting container, a dry rotary vane pump having a pressure side and a suction side, a tube and valve system having a first condition in which the suction side of the pump is connected to the collecting container for generating and maintaining a considerable partial vacuum in the sewer piping and in the collecting container, and a second condition in which the pressure side of the pump is connected to the collecting container for expelling the contents of the collecting container, and an air separation device for receiving sewage and air from the sewer piping and removing at least some of the air accompanying the sewage before delivering sewage into the collecting container.

2. An arrangement according to claim 1, wherein the sewer piping comprises a branch sewer pipe connected to each vacuum toilet and a common end tube to which the branch sewer pipes are connected, and the common end tube communicates with the collecting container through the air separation device.

3. An arrangement according to claim 1, wherein the air separation device comprises an air separation tube that is curved about an axis of curvature that extends within the collecting container, the air separation tube having an outlet end at which it debouches into the collecting container and being formed at its side that is closer to said axis of curvature with a plurality of apertures that are spaced apart along the air separation tube and open into the collecting container, whereby air that accompanies sewage in the air separation tube is separated from the sewage and passes into the collecting container.

4. An arrangement according to claim 3, wherein the collecting container has a cylindrical wall and the air separation tube is mounted in close relationship to the cylindrical wall of the collecting container.

5. An arrangement according to claim 4, wherein the air separation tube is disposed exteriorly of the cylindrical wall of the collecting container.

6. An arrangement according to claim 4, wherein the collecting container has a central axis that is offset from vertical and the air separation tube slopes downward toward its outlet end.

7. An arrangement according to claim 1, comprising an outlet tube for discharge of sewage that is expelled from the collecting container, the outlet tube having an inlet end that is disposed in close proximity to the lowest point of the interior space of the collecting container.

8. An arrangement according to claim 7, wherein the outlet tube is provided with a check valve preventing flow of fluid into the collecting container through the outlet tube.

9. An arrangement according to claim 1, wherein the sewer piping includes an end tube having an outlet opening for discharge of sewage into the collecting container, and the arrangement comprises a level monitor in the collecting container for transmitting a signal that initiates an emptying sequence when the collecting container contains sewage to a pre-set depth below the outlet opening of the end tube.

10. An arrangement according to claim 9, comprising a guide means arranged to direct air flowing into the collecting container when the tube and valve system is in the second condition against the level monitor for cleaning the level monitor of matter sticking thereto.

11. An arrangement according to claim 1, wherein the sewer piping comprises an end tube that includes a U-shaped portion acting as a collecting trap for liquid remaining in the sewer piping, sewage that collects in the trap subsequently being available to form a liquid plug.

12. An arrangement according to claim 11, wherein the end tube communicates with the collecting container through the air separation device, which is downstream of the U-shaped portion of the end tube.

13. An arrangement according to claim 1, wherein the tube and valve system comprises a single air duct for connecting the pump to the collecting container in both the first condition and the second condition of the tube and valve system and the arrangement further includes a moisture separation device connected in said single air duct.

14. An arrangement according to claim 13, wherein the moisture separation device includes a means for protecting the tube and valve system from overfilling of the collecting container.

15. An arrangement according to claim 14, wherein the protecting means comprises a float-operated valve incorporated in the moisture separation device.

16. An arrangement according to claim 1, wherein the number of toilet bowls does not exceed sixty.

17. An arrangement according to claim 1, wherein the volume of the collecting container does not exceed 100 liters.

18. An arrangement according to claim 1, wherein the arrangement defines a volume that is placed under considerable partial vacuum and the air separation device has at least one air outlet that communicates with said volume separately from the sewage.

19. An arrangement according to claim 18, wherein said one air outlet debouches into the collecting container.

* * * * *